US008931774B2

(12) United States Patent
Akashi

(10) Patent No.: US 8,931,774 B2
(45) Date of Patent: Jan. 13, 2015

(54) SHEET PROCESSING APPARATUS AND METHOD, AS WELL AS CONTROLLING APPARATUS

(75) Inventor: Masamichi Akashi, Eindhoven (NL)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 13/325,611

(22) Filed: Dec. 14, 2011

(65) Prior Publication Data

US 2012/0153555 A1 Jun. 21, 2012

(30) Foreign Application Priority Data

Dec. 15, 2010 (JP) ..... 2010-279276

(51) Int. Cl.
*B65H 45/20* (2006.01)
*B65H 45/14* (2006.01)
*B65H 45/28* (2006.01)

(52) U.S. Cl.
CPC ..... *B65H 45/142* (2013.01); *B65H 45/28* (2013.01); *B65H 2801/27* (2013.01)
USPC ..... 270/39.01; 270/32; 270/37

(58) Field of Classification Search
USPC ..... 270/32, 37, 39.01, 52.17, 52.18, 58.07, 270/58.08; 493/421, 430
See application file for complete search history.

(56) References Cited

U.S. PATENT DOCUMENTS

| | | | | |
|---|---|---|---|---|
| 6,085,913 | A * | 7/2000 | Aiko et al. | 209/540 |
| 6,873,426 | B1 * | 3/2005 | Farrell | 358/1.15 |
| 7,946,565 | B2 * | 5/2011 | Kubota et al. | 270/39.01 |
| 8,199,144 | B2 * | 6/2012 | Sakura et al. | 345/418 |
| 2007/0271881 | A1 | 11/2007 | Maemura et al. | |
| 2008/0237962 | A1 | 10/2008 | Kubota et al. | |
| 2009/0315240 | A1 | 12/2009 | Myoki | |

FOREIGN PATENT DOCUMENTS

| | | | |
|---|---|---|---|
| JP | 10-186959 | A | 7/1998 |
| JP | 2001-163514 | A | 6/2001 |
| JP | 2003-160274 | A | 6/2003 |
| JP | 2006-193288 | A | 7/2006 |
| JP | 2008-247533 | A | 10/2008 |
| JP | 2010-002859 | A | 1/2010 |
| KR | 20060109900 | A | 10/2006 |

OTHER PUBLICATIONS

European Search Report issued in counterpart application No. EP11009815.9, dated Mar. 29, 2012.
Office Action issued in corresponding Japanese Patent Application No. 2010-279276, dated Sep. 22, 2014.
Korean Office Action cited in Korean counterpart application No. KR10-2011-0134492, dated Jun. 16, 2014.

* cited by examiner

*Primary Examiner* — Leslie A Nicholson, III
(74) *Attorney, Agent, or Firm* — Rossi, Kimms & McDowell LLP

(57) ABSTRACT

A sheet processing apparatus which is capable of completing a bound document containing appropriately Z-folded sheets when performing folding together with edge cutting and binding. The sheet processing apparatus controls a Z-folding process, a cutting process, and a binding process for a sheet. A first folding position from a free end of the sheet coincides with a position corresponding to half a width of the sheet excluding a cut width of the sheet a binding margin, when the Z-folding process, the cutting process, and the binding process are executed.

10 Claims, 10 Drawing Sheets

SHEET PROCESSING APPARATUS AND METHOD, AS WELL AS CONTROLLING APPARATUS

BACKGROUND OF THE INVENTION

1. Field of the Invention

The present invention relates to a sheet processing apparatus equipped with a sheet processing unit which performs sheet processing, including folding, cutting, and binding, on sheets and to a sheet processing method, as well as a controlling apparatus.

2. Description of the Related Art

Recent printing systems and the like intended for the POD (print-on-demand) market are configured by connecting a printer directly with various sheet processing apparatuses (by in-line connection) and adapted to perform folding, cutting, and binding such as stapling or case binding on the printed sheets.

If such printing systems and the like perform folding and cutting in combination, a portion around a fold line produced by the folding could be cut off. Furthermore, when the folding and the binding are performed in combination, the portion around the fold line produced by the folding could be bound by staples or the like.

Therefore, in the printing systems and the like, operations on a control panel are limited so as to disable the cutting after the folding. Also, operations on the control panel are limited so as to disable the combined use of a specific folding (e.g., Z-folding) and a specific cutting (e.g., edge cutting).

Thus, in relation to the conventional printing systems and the like, a technique has been proposed in order to prevent the fold lines from being cut off. The technique involves, for example, placing two fold lines on the inner side of the respective sheet edges during Z-folding to thereby displace the fold lines so as to avoid portions around the fold lines from being cut off. Also, in relation to conventional sheet processing apparatus and the like, a technique has been proposed of determining whether or not sheets include any part to be eventually cut off and changing fold line positions based on the determination result (see Japanese Laid-Open Patent Publication (Kokai) No. 2001-163514, for example).

Also, with the conventional sheet processing apparatus and the like, if a cutting position of a sheet is affected by folding, printing of the sheet to be folded is interrupted. For the conventional sheet processing apparatus and the like, a technique has been proposed of changing fold line positions by prompting a user to enter an input for folding position adjustment again (see Japanese Laid-Open Patent Publication (Kokai) No. 2010-002859, for example).

Furthermore, some conventional sheet processing apparatuses and the like are designed to be able to extract and subsequently cut only sheets to be not subjected to folding. In relation to these conventional sheet processing apparatuses and the like, when there is a mixture of sheets which require folding and sheets which require no folding, it is proposed to sort the sheets into a type of sheet requiring folding and a type of sheet requiring no folding and then output the two types of sheet separately (see Japanese Laid-Open Patent Publication (Kokai) No. 10-186959, for example).

In relation to some conventional sheet processing apparatuses and the like, a folding position adjustment technique for a plurality of folding manners including Z-folding has been proposed (see Japanese Laid-Open Patent Publication (Kokai) No. 2006-193288, for example).

However, the use of the conventional techniques described above involve problems described below.

For example, when a specific folding such as Z-folding and a specific cutting such as edge cutting are combined, it is conceivable to use measures described in Japanese Laid-Open Patent Publication (Kokai) No. 2001-163514 and Japanese Laid-Open Patent Publication (Kokai) No. 2010-002859. In so doing, if the first folding position from a base end of the sheet is adjusted automatically, only a single folding position can be adjusted automatically. Consequently, when these measures are used, a distance between the first folding position and the second folding position from the base end of the sheet becomes fixed. This results in a Z-fold of undesirable style in which the distance of the second folding position from the base end of the sheet is longer than half the sheet.

If binding is done in addition to folding and edge cutting, only the first folding position from the base end of the sheet can be adjusted automatically as is the case with the techniques described in Japanese Laid-Open Patent Publication (Kokai) No. 2001-163514 and Japanese Laid-Open Patent Publication (Kokai) No. 2010-002859. Consequently, if the sheet marked for folding is wide, requiring a large cut width, the second folding position from the base end of the sheet will overlap the binding position, resulting in an unexpected output.

SUMMARY OF THE INVENTION

The present invention provides a sheet processing apparatus and method, as well as a controlling apparatus, which are capable of completing a bound document containing appropriately Z-folded sheets when performing folding together with edge cutting and binding.

According to as aspect of the invention, there is provided a sheet processing apparatus controlling a Z-folding process, a cutting process, and a binding process for a sheet, comprising: a cut width acquisition unit configured to acquire a cut width of the sheet for the cutting process; a binding margin acquisition unit configured to acquire a binding margin for the binding process; and a control unit configured to take control such that a first folding position from a free end of the sheet coincides with a position corresponding to half a width of the sheet excluding the cut width acquired by said cut width acquisition unit and the binding margin acquired by said binding margin acquisition unit, when the Z-folding process, the cutting process, and the binding process are executed.

With this arrangement, it is possible to complete a bound document containing an appropriately Z-folded sheet by adjusting a first folding position and a second folding position of the Z-folded sheet when performing folding together with edge cutting and binding.

Further features and advantages of the present invention will become apparent from the following detailed description of exemplary embodiments with reference to the attached drawings.

BRIEF DESCRIPTION OF THE DRAWINGS

FIG. 6A shows a sheet outputted from a printer unit in FIG. 2, FIG. 6B shows a manner of a double-stapling process being performed on sheets, and FIG. 6C shows a bundle of sheets after the double-stapling process.

FIG. 8A shows sheets outputted from the printer unit, FIG. 8B shows a manner of a Z-folding process and double-stapling process being performed on sheets, FIG. 8C shows a manner of a cutting process being performed on the sheets, and FIG. 8D shows a bundle of the cut sheets.

DETAILED DESCRIPTION OF THE EMBODIMENTS

The present invention will now be described in detail with reference to the drawings.

Figure 1:
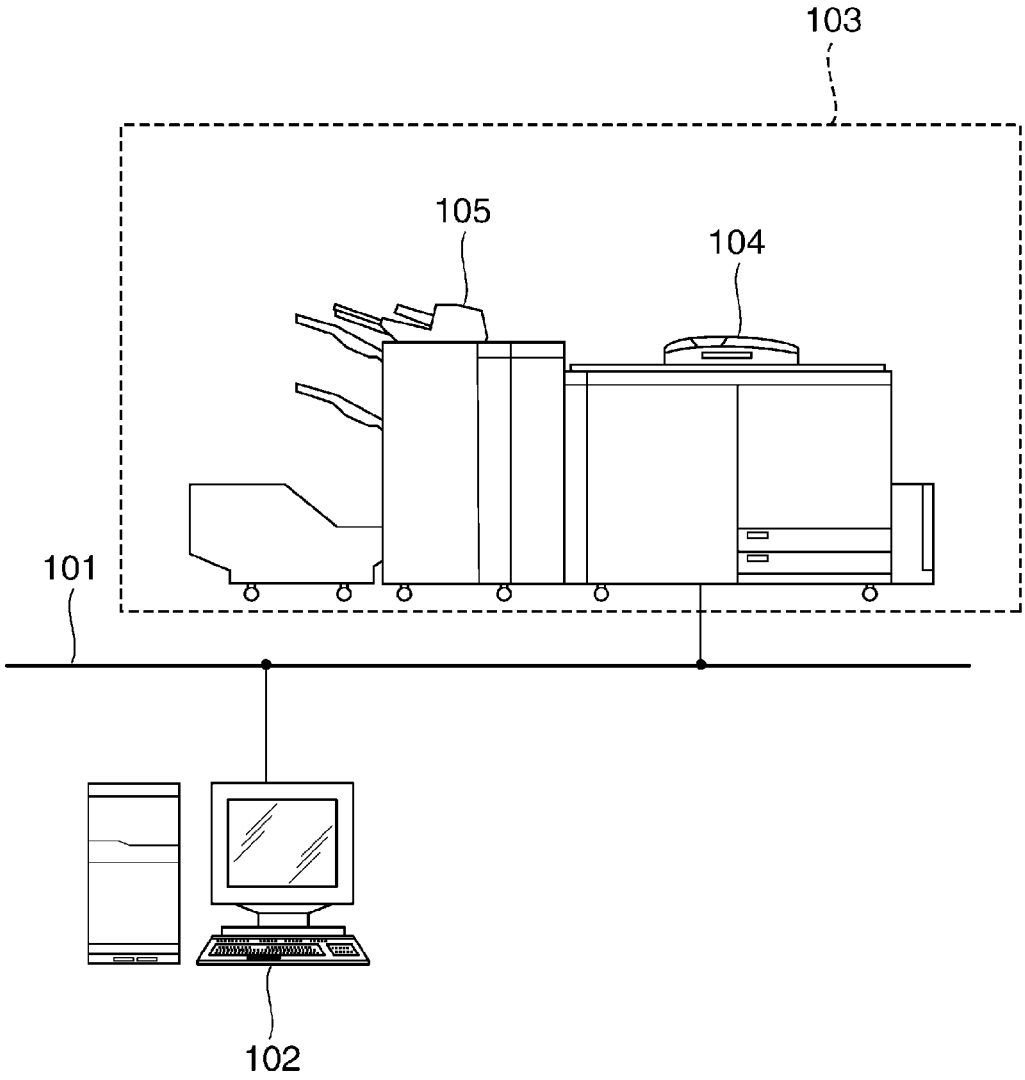
FIG. 1 is a view schematically showing a construction of a printing system equipped with a sheet processing apparatus according to an embodiment of the present invention.

FIG. 1 is a view schematically showing a construction of a printing system equipped with a sheet processing apparatus according to an embodiment of the present invention.

In FIG. 1, a client computer (PC) 102 and a printing system 103 are interconnected via a network 101. The client computer (PC) 102 transmits image data as well as a command of specifying post-processing to the printing system 103 via the network 101. The printing system 103 includes a printing apparatus 104 and a post-processing apparatus 105.

Next, a description will be made of an internal construction of the printing apparatus 104 in FIG. 1 with reference to a block diagram of FIG. 2.

Figure 2:
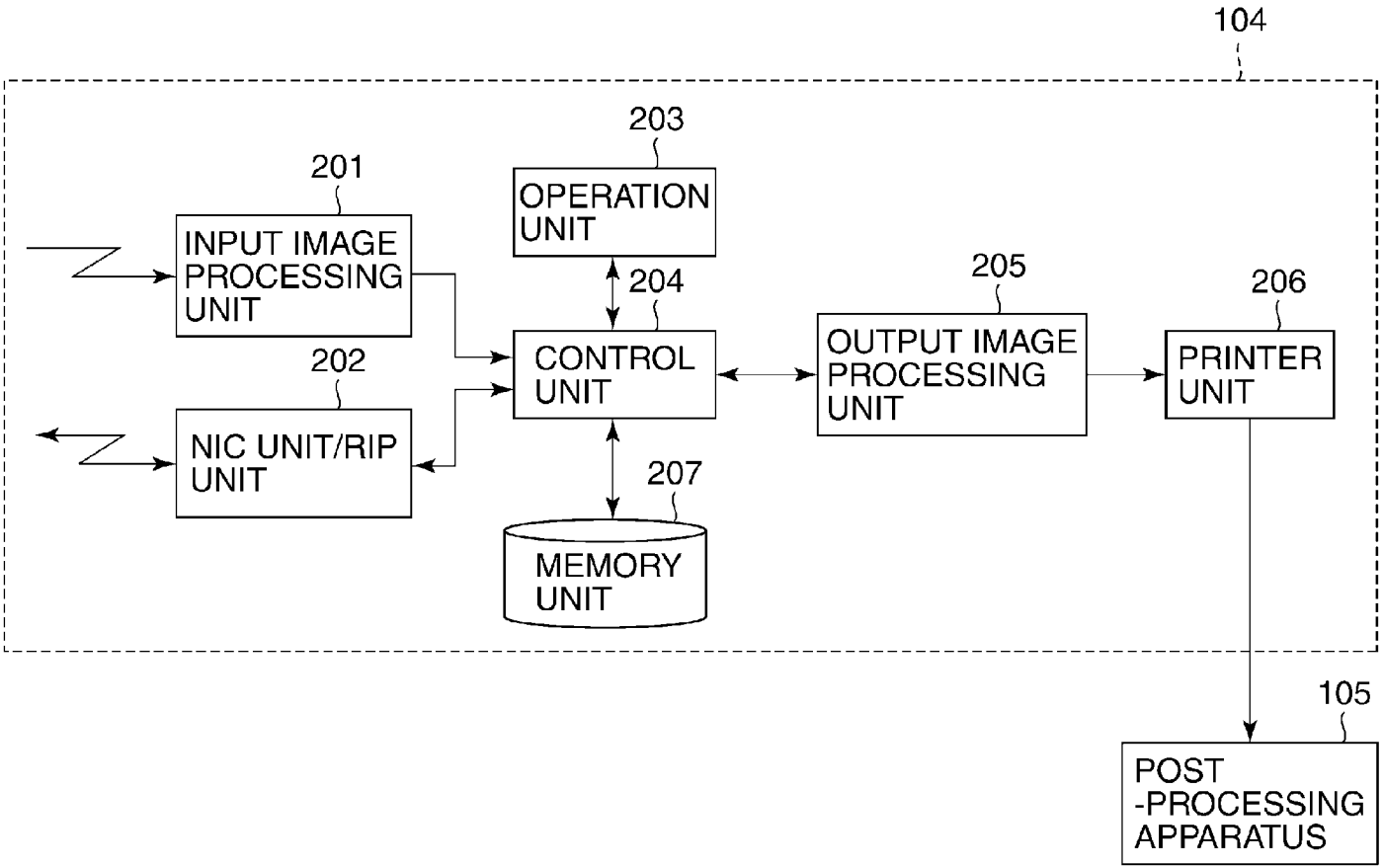
FIG. 2 is a block diagram showing an internal construction of a printing apparatus in FIG. 1.

In FIG. 2, the printing apparatus 104 of the printing system 103 is a multi function peripheral (MFP) which has multiple functions including copier functions and printer functions.

The printing apparatus 104 may be comprised of a single-function printing apparatus (printer) provided with, for example, only copier functions or printer functions.

The printing apparatus 104 includes various units other than the post-processing apparatus 105. Furthermore, the printing apparatus 104 is adapted to be connectable with the post-processing apparatus 105 comprised of an arbitrary number of units.

The post-processing apparatus 105 connected to the printing apparatus 104 is configured to perform post-processing on sheets printed by the printing apparatus 104. It should be noted that the printing system 103 may be comprised of only the printing apparatus 104 without the post-processing apparatus 105 connected to the printing apparatus 104.

The post-processing apparatus 105 is adapted to communicate with the printing apparatus 104 to thereby perform post-processing (described later) on instructions from the printing apparatus 104.

A description will now be made of individual components of the printing apparatus 104 with reference to a block diagram of FIG. 2.

The printing apparatus 104 includes an input image processing unit 201, an NIC unit/RIP unit 202, an operation unit 203, a memory unit 207, an output image processing unit 205, and a control unit 204 connected therewith. Besides, the printing apparatus 104 includes a printer unit 206 connected to the output image processing unit 205. To the printer unit 206 is connected a post-processing apparatus 105.

The input image processing unit 201 reads images from a source document, converts the images into image data, and transfers the image data to the other units.

The NIC unit/RIP unit 202 exchanges data with the other units connected to the network 101, interprets received PDL (Page Description Language) data, converts the PDL data into raster data, and transfers the raster data to other units.

The output image processing unit 205 performs image processing suitable for the printer unit 206 on inputted image data. The printer unit 206 prints images on sheets based on the image data subjected to output image processing.

The operation unit 203 includes a hard key input unit (key input unit) 302 and a touch panel unit 301 and accepts commands from the user therethrough. Also, the operation unit 203 produces various displays on the touch panel unit 301.

The control unit 204 exerts overall control over processes and operations of various units in the printing system 103. That is, the control unit 204 also controls operations of the printing apparatus 104 and the post-processing apparatus 105 connected to the printing apparatus 104.

The memory unit 207, which is connected to the control unit 204, stores various computer programs to be executed by the control unit 204, image data which has been processed by the input image processing unit 201, and image data which has been processed by the NIC unit/RIP unit 202. Specifically, the memory unit 207 stores, for example, a program which causes the control unit 204 to perform various processes shown in a flowchart (described later) and a display control program needed to display various settings screen (described later).

Also, the memory unit 207 stores a program used by the NIC unit/RIP unit 202 to translate PDL (Page Description Language) data received from the client computer (PC) 102 into raster image data. Furthermore, the memory unit 207 stores a boot sequence, font information, and the like.

Figure 3:
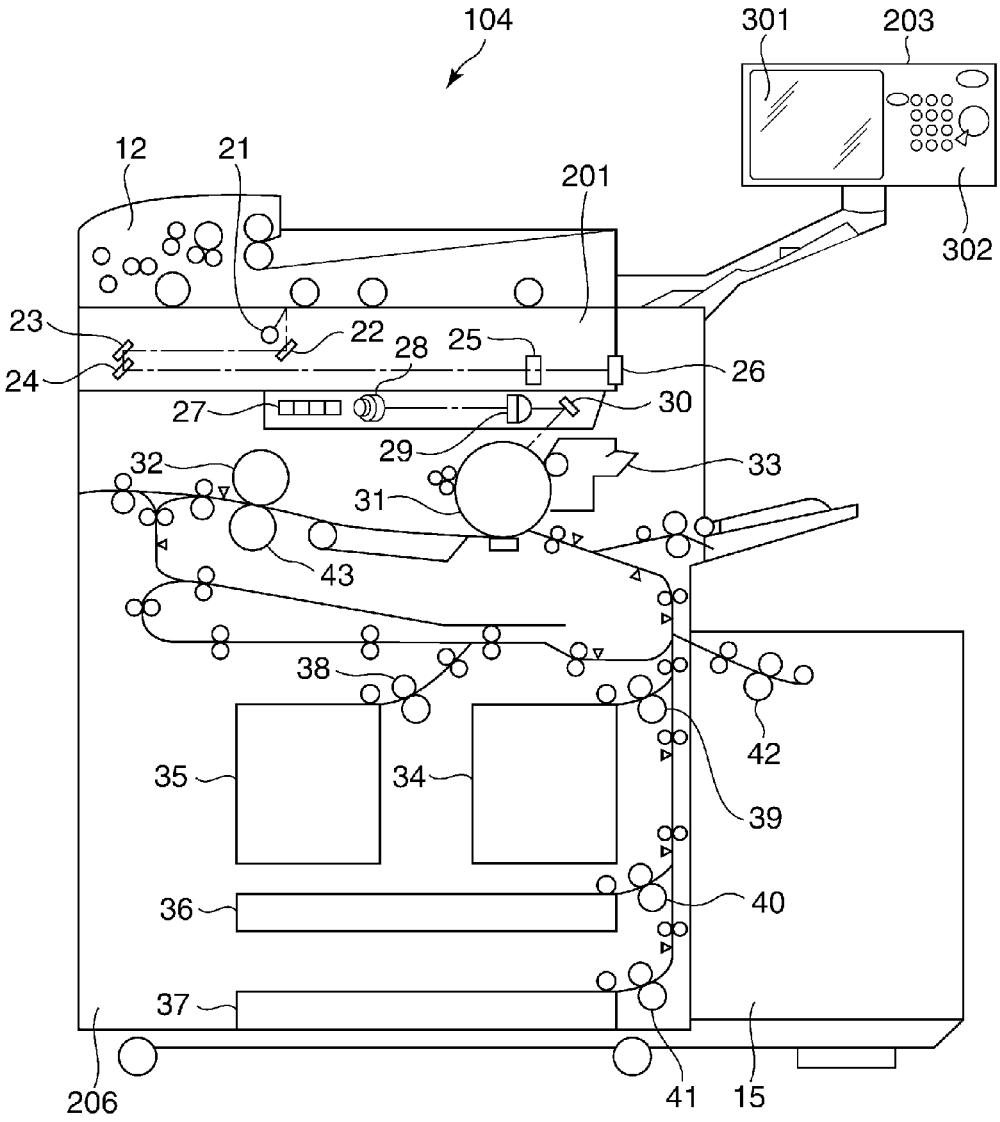
FIG. 3 is a view schematically showing the internal construction of the printing apparatus in FIG. 1.

A description will now be further made of the internal construction of the printing apparatus 104 in FIG. 1 with reference to FIG. 3.

In FIG. 3, the printing apparatus 104 mainly includes the input image processing unit 201 which reads source image data and the printer unit 206 which outputs source images to recording sheets.

The printing apparatus 104 is adapted to carry out operations due to the user's operation of the operation unit 203 of entering a copy mode command or the like. Furthermore, the printing apparatus 104 is adapted to display various settings and current job status of the printing apparatus on the touch panel unit 301 of the operation unit 203 in response to the user actions. The printing apparatus 104 is adapted to display a "call service person" message on the touch panel unit 301 in case of trouble in the printing apparatus and display the position of a recording sheet stuck in the apparatus on the touch panel unit 301 in case of a jam.

The printing apparatus 104 has paper feed trays 34, 35, 36, and 37 in the printer unit 206 to store recording sheets into which the recording sheets are sorted according to paper size and paper type as desired by the user. Also, the printer unit 206 can be externally connected with a large-capacity paper deck 15.

In the printing apparatus 104, the recording sheets stored in the paper feed trays 34, 35, 36, and 37 and a paper deck 15 are conveyed to an image forming unit by paper feed/conveyance rollers 38, 39, 40, 41, and 42 driven by a motor (not shown).

The printing apparatus 104 has the input image processing unit 201 installed on a top portion thereof. In the input image processing unit 201, a light source 21 adapted to move right and left in FIG. 3 emits light onto a source document placed on a document glass plate on a top face of the input image processing unit 201, and an optical image produced by the light reflected off the source document is focused onto a CCD 26 through mirrors 22, 23, and 24 and a lens 25. The CCD 26 converts the focused optical image into an electrical signal as digital image data, which is subjected to an image conversion process such as scaling at the request of the user, and the data resulting from the image conversion process is stored in the memory unit 207.

In the printing apparatus 104, at the time of image output, the printer unit 206 calls up the image data stored in the memory unit 207 and reconverts the digital signal into an analog signal. The printer unit 206 converts the analog signal into an optical signal of a laser beam using an optical irradiation unit 27, and irradiates a photosensitive drum 31 via a scanner 28, lens 29, and a mirror 30 to thereby scan the photosensitive drum 31.

The photosensitive drum 31, having a photoconductive layer comprised of organic photoconductive material on an surface thereof, is rotationally driven at a fixed speed during a copy job, which causes an electrostatic latent image corresponding to the image data to be formed on the surface of the photosensitive drum 31.

Onto the surface of the photosensitive drum 31 having the electrostatic latent image formed thereon is adhered toner transferred from a developing device 33 filled with toner (not shown), thereby enabling a visible image to be formed.

On the other hand, recording sheets are conveyed from the paper feed tray 34, 35, 36, or 37 through paper conveyance paths and rolling-contact to the photosensitive drum 31 at a bottom thereof, in synchronization with the visible image. Then, the visible image on the photosensitive drum 31 is transferred to the recording sheet by a transfer charger 48.

The recording sheet carrying the visible toner image (not-yet fixed image) is introduced into between a fixing roller 32 and a pressure roller 43 of a fixing device and heated under pressure there, and consequently the visible toner image is fixed to the recording sheets. The image-formed recording sheet with the toner fixed is discharged onto the post-processing apparatus 105 outside the printing apparatus 104.

A description will next be made of the internal construction of the post-processing apparatus 105 in FIG. 1 with reference to FIG. 4.

Figure 4:
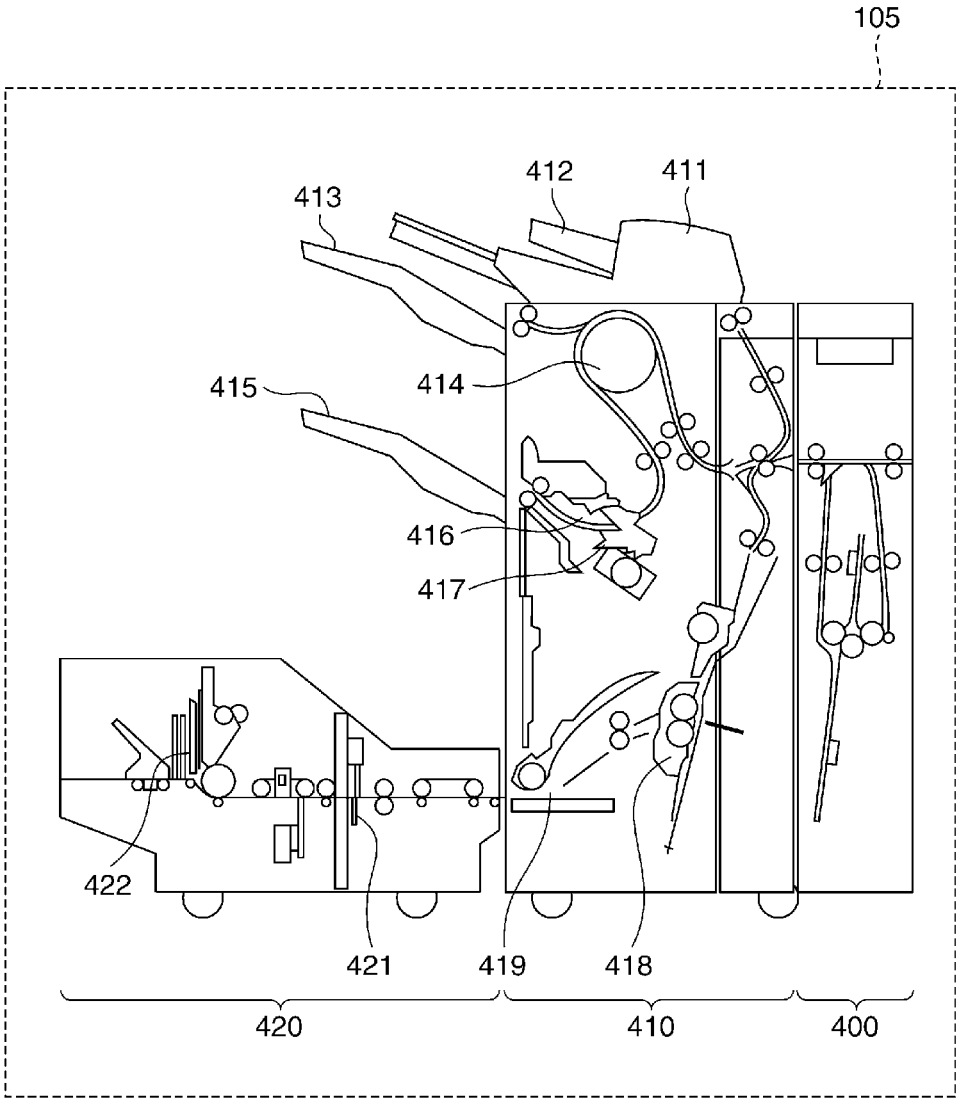
FIG. 4 is a view schematically showing an internal construction of a post-processing apparatus in FIG. 1.

In FIG. 4, the post-processing apparatus 105 is adapted to link any number of units of any type as long as sheets with images formed thereon by the printing apparatus 104 can be conveyed from upstream units to downstream units.

In the post-processing apparatus 105 of FIG. 4, a paper folding machine 400, a saddle stitch binding machine 410, and a cutting machine 420 are linked in the order named with respect to the distance from the printing apparatus 104. The various units of the post-processing apparatus 105 are designed to be selected and used freely in the printing system 103. Also, each unit of the post-processing apparatus 105 is equipped with a discharge unit, allowing the user to take the post-processed sheets out of the discharge unit.

For example, the sheets discharged from the fixing device of the printing apparatus 104 enter the post-processing apparatus 105. The post-processing apparatus 105 is equipped with paper output trays 413, 415 as paper output destinations. The discharged sheets are stacked on the paper output trays 413, 415 selectively according to the type of job, the number of sheets discharged, and desires of the user.

Also, the paper folding machine 400 and the saddle stitch binding machine 410 are placed on the transport path leading to the paper output trays 413, 415. The paper folding machine 400 includes a multi-function folding unit of which functions include a Z-folding function (described later). The multi-function folding unit folds the sheet twice into the shape of a letter Z as viewed from the long side of the sheet using so-called Z-folding. The sheet folded by the paper folding machine 400 is sent to the saddle stitch binding machine 410.

The saddle stitch binding machine 410 is equipped with a saddle stitcher 418. The saddle stitcher 418 binds a central part of the sheets at two locations, inserts the midsection of the sheets under a roller, thereby folding the bundle of sheets in the middle, and creates a booklet such as a magazine or pamphlet. The sheets book-bound by the saddle stitcher 418 are discharged onto a booklet tray 419 and then conveyed to a cutting machine connected to the booklet tray 419.

The saddle stitch binding machine 410 is equipped with a puncher 414 and is capable of punching holes in the sheets. The saddle stitch binding machine 410 is equipped with a double-stapling unit 417 and is capable of applying double-stapling to an end of the sheet. The saddle stitch binding machine 410 is equipped with an inserter 411 and is capable of performing saddle stitch binding, double-stapling, and punching by supplying sheets from an insert tray 412.

After being thus subjected to saddle stitch binding by the saddle stitcher 418 or subjected to punching and double-stapling, the bundle of sheets is transported to the cutting machine 420 via the booklet tray 419.

The cutting machine 420 trims an edge of the book-bound bundle of sheets neatly by a cutter unit 421 cutting off the edge by a predetermined length. After going through cutting, the bundle of sheets is stored in a booklet holding unit 422. In addition to the cutter unit 421, the cutting machine 420 has cutter units (not shown) respectively placed both on the near side and far side in the conveyance direction of the bundle of sheets to enable three-sided cutting as well as edge cutting.

Next, a description will be made of a concrete operation of the paper folding machine 400 with reference to FIG. 5A. Incidentally, technical details of the paper folding machine 400 are described in Japanese Laid-Open Patent Publication (Kokai) No. 2006-193288.

Figure 5A:
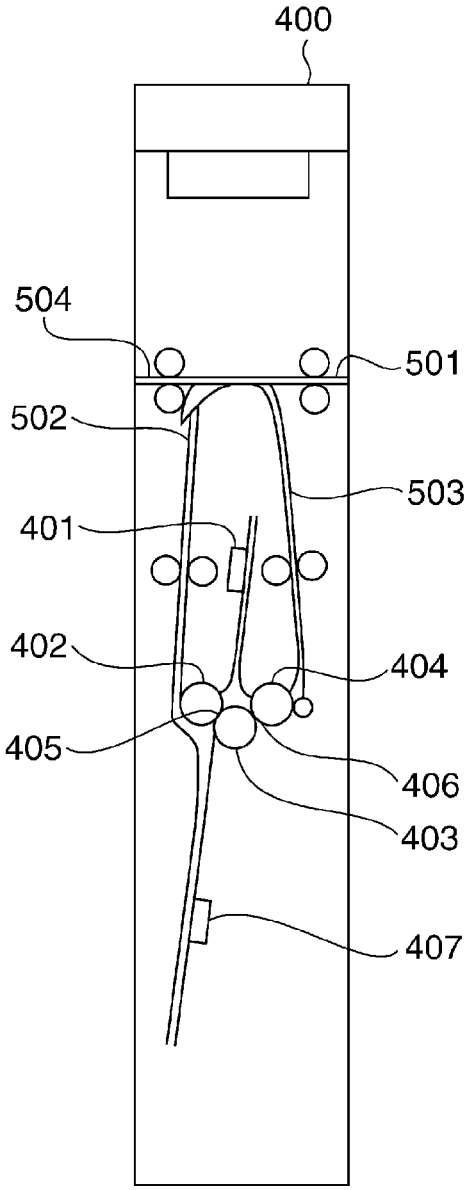
FIG. 5A is a view schematically showing an internal construction of a folding machine in FIG. 4.

In FIG. 5A, the sheet discharged through the fixing device of the printing apparatus 104 is carried into the paper folding machine 400 through a conveyance path 501. The sheet carried into the paper folding machine 400 is conveyed on a conveyance path 502 and caused to hit a first stopper 407. Subsequently, the sheet continues to be conveyed to thereby form the first loop. The looped portion of the sheet is thrust into a nip 405 by folding rollers 402, 403, and then conveyed by the folding rollers 402, 403 under pressure and hence folded in half.

Figure 5B:
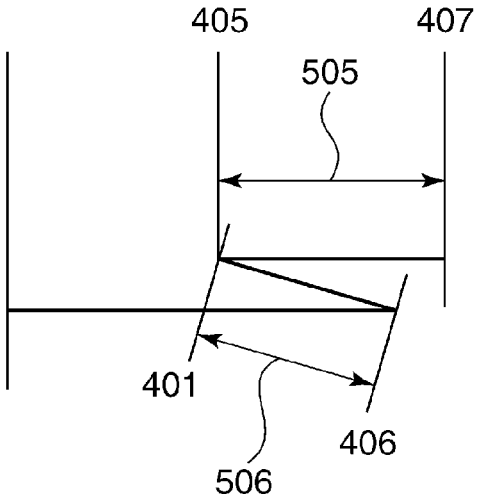
FIG. 5B is a view which is useful in explaining Z-folded portions of a sheet folded by the folding machine of FIG. 5A.

The paper folding machine 400 adjusts vertical position of the stopper 407 to thereby vary the distance between the stopper 407 and the nip 405 and to thereby adjust a distance 505 of a Z-folded portion shown in FIG. 5B. That is, adjusting the vertical position of the stopper 407 causes the paper folding machine 400 to form a "first fold of Z-folding" which is the first fold from a free end of the sheet (second fold from a base end of the sheet).

Furthermore, the paper folding machine 400 continues to convey the sheet folded in half upward, hits the sheet against a second stopper 401, continues conveyance after the hit to thereby cause the sheet to form a loop. The second loop of the sheet thus formed is thrust into a second nip 406 by folding rollers 403, 404, and then conveyed under pressure by the folding rollers 403, 404 to thereby form a second fold line.

The paper folding machine 400 moves the second stopper 401 vertically to thereby vary the distance between the second stopper 401 and the second nip 406, and to thereby adjust a Z-folded width 506 shown in FIG. 5B. That is, adjusting the vertical position of the second stopper 401 causes the paper folding machine 400 to form a "second fold of Z-folding" which is the second fold from the free end of the sheet (first fold from the base end of the sheet).

In the paper folding machine 400, the sheet which has been Z-folded is conveyed via a sheet conveyance path 503 to the post-processing apparatus downstream of a conveyance path 504.

A descriptions will now be made of control details and operation of the control unit of the printing system of FIG. 1.

In the printing system, the control unit 204 causes the printer unit 206 to print based on print data contained in a print request (print job) issued at the direction of the user. At the same time, the control unit 204 analyzes print control information similarly contained in the print request (print job) and subsequently determines what type of post-processing is needed.

Then, the control unit 204 conveys the print-processed sheet to a unit of the post-processing apparatus 105 in order for the post-processing apparatus 105 to perform specified post-processing.

Figure 6A:
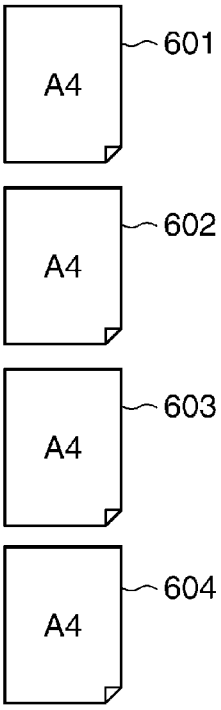
FIGS. 6A to 6C are views which are useful in explaining a print job carried out by the printing system of FIG. 1, where

A description will now be made of an example of a print job for the printing system with reference to FIGS. 6A to 6C, assuming that the print job uses four A4-size sheets for print data and includes a process performed when double-stapling is specified in print control information.

In the printing system, when executing the print job which includes a process performed with double-stapling specified, the control unit 204 causes the printer unit 206 to perform printing based on the print data. Consequently, the printer unit 206 outputs printed sheets 601, 602, 603, and 604 as shown in FIG. 6A.

Figure 6B:
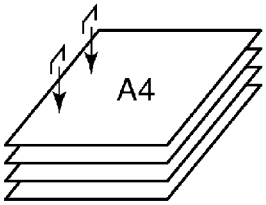

Next, as shown in FIG. 6B, the control unit 204 transports the printed sheets 601 to 604 to the saddle stitching machine 410 via the paper folding machine 400 and causes the double-stapling unit 417 to perform a double-stapling process.

Figure 6C:
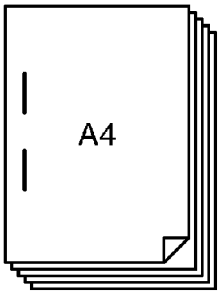

Finally, the control unit 204 takes control to cause a stapled bundle of sheets (reference) such as shown in FIG. 6C to be discharged onto the booklet tray 419 and loaded onto the booklet holding unit 422 via the cutting machine 420. This completes the print job which includes a process performed with double-stapling specified.

A description will now be made of another example of a print job for the printing system with reference to FIGS. 8A to 8D, assuming that the print job uses a mixture of A4 plus sheets and a A3 plus sheet for print data and includes a process performed with a binding margin and a cut width for double-stapling are specified. It should be noted that although in the present embodiment, a position of cutting is specified by the distance from an end of the sheet, the position of cutting may be specified by finished size resulting from the cutting.

Figure 7:
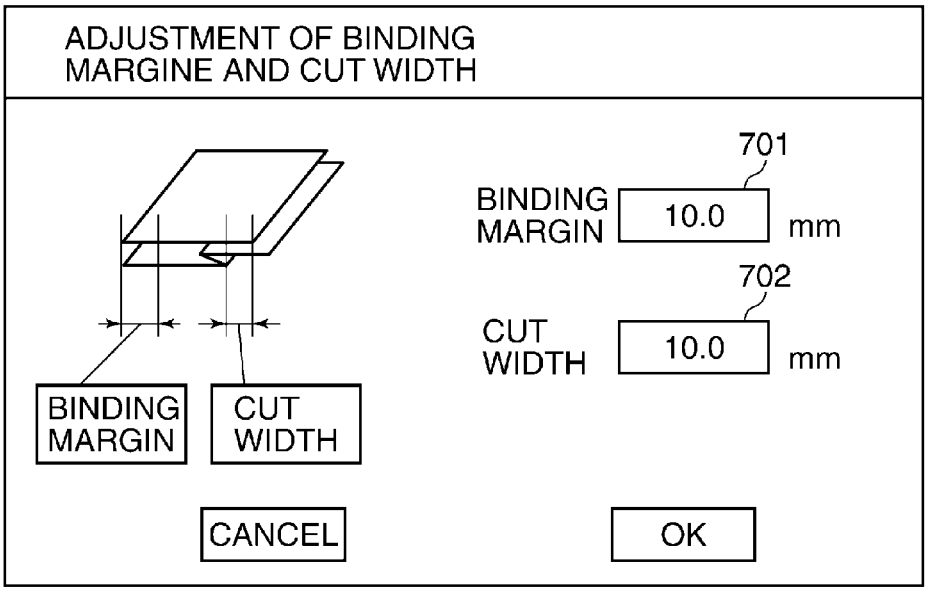
FIG. 7 is a view which is useful in explaining a screen on a touch panel unit in the printing system of FIG. 1.

When starting the print job, the user specifies a binding margin 701 and a cut width 702 using the operation unit 203 or a driver (not shown) on the client PC 102, as shown in FIG. 7 by way of example.

Figure 8A:
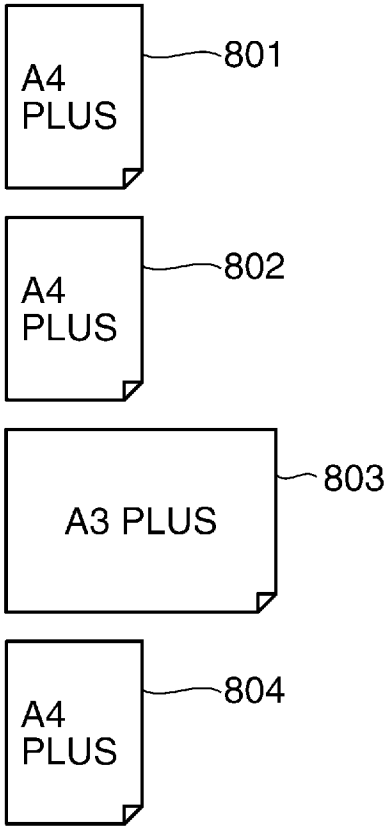
FIGS. 8A to 8D are views which are useful in explaining a print job carried out by the printing system in FIG. 1, where

As shown in FIG. 8A by way of example, it is assumed that the first sheet 801, the second sheet 802, and the fourth sheet 804 are of A4 plus size and the third sheet 803 is of A3 plus size.

The printing system Z-folds the A3 plus sized sheet 803 under the control of the control unit 204. Then, the printing system stacks the first sheet 801, the second sheet 802, the third sheet 803, and the fourth sheet 804 in order.

Figure 8B:
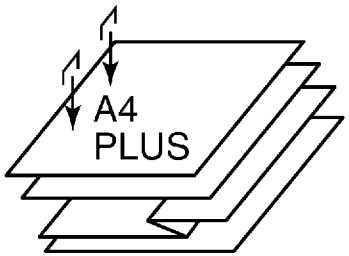

Next, under the control of the control unit 204, the printing system performs a double stapling process on the outer side of the sheet's binding margin specified by the user, as shown in FIG. 8B.

Figure 8C:
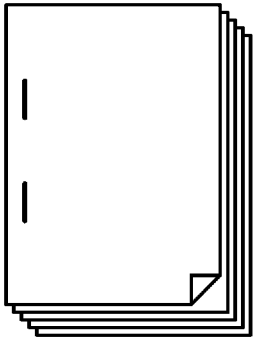
Figure 8D:
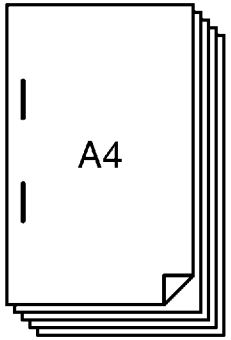

Next, under the control of the control unit 204, the printing system performs a cutting process as shown in FIG. 8C and outputs a bound document such as shown in FIG. 8D resulting from the cutting.

A description will now be made of details of Z-folding performed by the printing system to produce a good-looking bound document with reference to FIGS. 9A and 9B, taking as an example a mixture of A4 plus sheets and an A3 plus sheet such as described above.

Figure 9B:
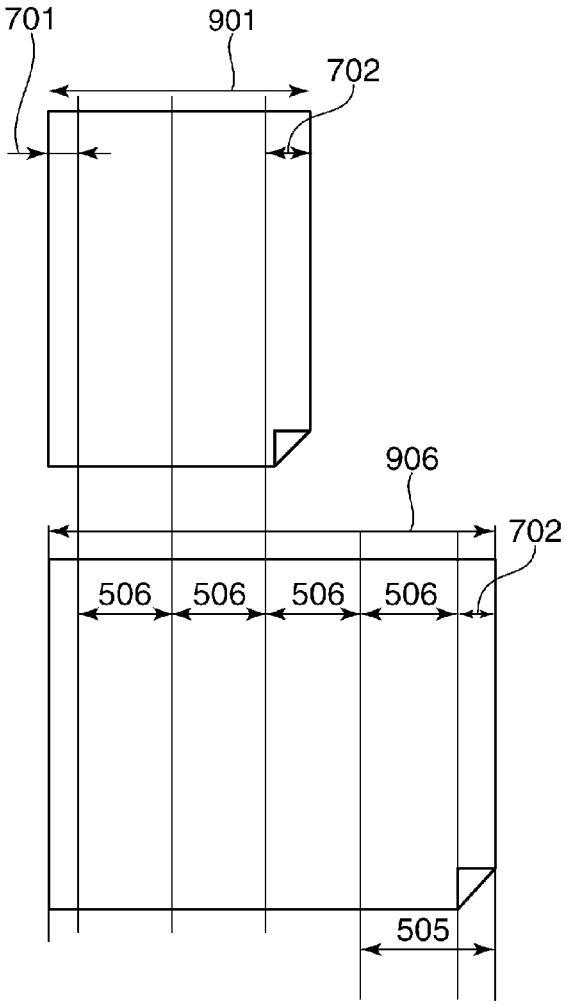
FIGS. 9A and 9B are views which are useful in explaining folding positions of sheets in a folding process performed by the post-processing apparatus of FIG. 4.
Figure 9A:
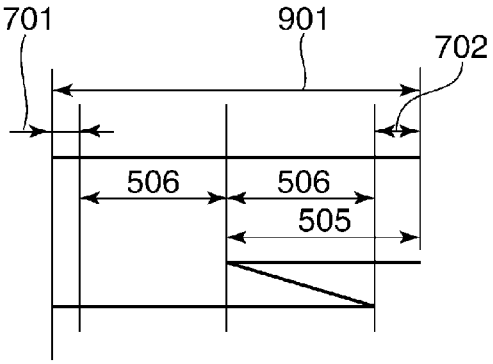

Specifically, a "good-looking bound document" means a bound document folded such that the second folding position will coincide with a position corresponding to approximately half the sheet width excluding any cut width and binding margin as shown in FIGS. 9A and 9B.

The A4 plus size is a size slightly larger than the A4 size (210 mm wide by 297 mm long). Although there are no fixed values, it is assumed here that the A4 plus size measures 220 mm wide by 307 mm long. Also, the A3 plus size is a size slightly larger than the A3 size (420 mm wide by 297 mm long). Although there are no fixed values, it is assumed here that the A3 plus size measures 450 mm wide by 307 mm long. On the other hand, it is assumed that the cut width is 10 mm as specified by the user.

Also, as shown in FIG. 7, the binding margin 701 entered and specified by the user and acquired by a binding margin acquisition unit adapted to acquire the binding margin is 10 mm. Also, the cut width 702 acquired by a cut width acquisition unit adapted to acquire the cut width is 10 mm.

In the example shown in FIGS. 9A and 9B, to perform ideal ¼ Z-folding for a good-looking bound document, it is necessary to fold the sheet at the position corresponding to half the size obtained by subtracting the binding margin and the cut width from the A4 plus size.

Specifically, the distance 506 corresponding to the folding width is given by (220−10−10)/2=100 mm which is equal to half the value obtained by subtracting the cut width of 10 mm and binding margin of 10 mm from the A4 plus size of 220 mm.

Next, to determine the distance 505 from the end shown in FIGS. 9A and 9B, the cut width 702 is added to the Z-folded width 506. That is, the distance 505 from the end is given by 100 mm+10 mm=110 mm.

The control unit 204 takes control to perform Z-folding by adjusting the positions of the second stopper 401 and the first stopper 407 in the paper folding machine 400 shown in FIG. 5 using the distance 505 from the end determined as described above.

In this way, the printing system in FIG. 2 can perform ideal Z-folding without cutting a fold during cutting work or binding a portion around the fold during binding work and without specifying complex folding positions.

It should be noted that although an example of using an A4 plus size and an A3 plus size has been described in relation to the print job including a process performed with double-stapling specified, the present invention is not limited to this.

The printing system in FIG. 1 can apply the present method to any size as long as the size is supported by the printing system. In this case, in determining folding positions based on the cut width and the binding margin specified by the user and on paper size, the control unit 204 of the printing system 103 uses generalized calculation formulae described below. The distances or widths used are as shown in FIGS. 9A and 9B.

Z-folded width 506=(sheet width 901−cut width 702−binding margin 701)/2 Calculation formula (1)

Distance 505 from the end=Z-folded width 506+cut width 702 Calculation formula (2)

The sheet width represents the paper size.

In short, the control unit 204 performs Z-folding in such a way that the first fold line from the free end of the sheet will fall on the position corresponding to the size of half the value obtained by subtracting the cut width 702 and the binding margin 701 specified by the user from the sheet width 901. Thus, the size resulting from addition of the cut width to the size of half the value obtained by subtracting the cut width 702 and the binding margin 701 specified by the user from the sheet width 901 is set to correspond to the distance of the first fold line from the free end of the sheet before cutting.

That is, as can be seen from the above calculation formulae, once the cut width 702 and the binding margin 701 are determined, an ideal folding position can be determined automatically based on the sheet width 901 representing the paper size.

A description will now be made of the print job processing performed by the printing apparatus 104 shown in FIG. 2 with reference to a flowchart of FIG. 11.

A processing program used to control the print job processing is stored in the memory unit 207 and executed by the control unit 204.

Figure 11:
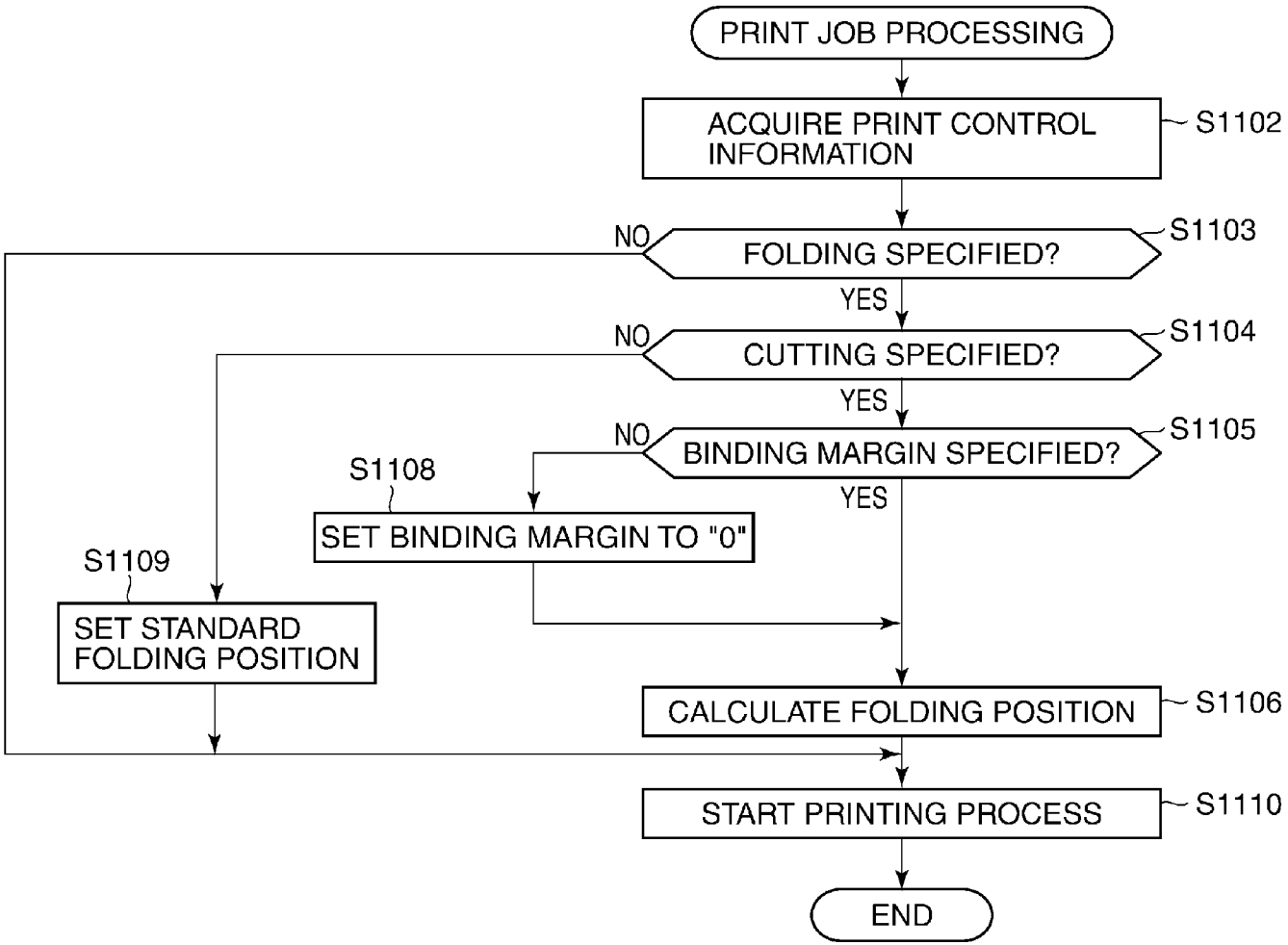
FIG. 11 is a flowchart showing the procedure of print job processing performed by the printing apparatus of FIG. 2.

In FIG. 11, first print control information of a print job which specifies printing is acquired (step S1102).

Next, the print control information acquired in step S1102 is scanned to determine whether or not folding is specified for the print job (step S1103).

As a result of the determination of the step S1103, when there is a sheet specified to be folded, the program proceeds to step S1104.

Next, the print control information acquired in step S1102 is scanned to determine whether or not cutting is specified for the print job, i.e., whether or not the print job is subjected to cutting (step S1104).

As a result of the determination of the step S1104, when the cutting is specified for the print job (YES to the step S1104), the program proceeds to step S1105.

Next, the print control information acquired in step S1102 is scanned to determine whether or not binding or a binding margin is specified for the print job (step S1105).

Moreover, the order of steps S1103, S1104, and S1105 above is arbitrary.

As a result of the determination of the step S1105, when there is no sheet for which a binding margin is specified, the binding margin is set to "0" (step S1108) and subsequently the folding position is calculated (step S1106), to perform a normal printing process.

Subsequently, a printing process is performed based on the print data and print control information contained in the print job, followed by the program terminating (step S1110).

On the other hand, if it is determined in the step S1105 that a binding margin has been specified, (YES to the step S1105), the control unit 204 calculates the folding position using the calculation formulae described above (step S1106).

Next, a printing process is performed based on the folding position calculated in the step S1106 as well as on the binding margin and the cut width (step S1110), followed by the program terminating.

If it is determined in the step S1104 that the print job is not subjected to cutting (NO to the step S1104), a standard folding position is set (step S1109), and subsequently a printing process is performed based on the standard folding position (step S1110), followed by the program terminating.

As described above, according to the printing system of FIG. 1, it is possible to avoid inadvertently cutting or binding a bundle of sheets containing the folded sheet. Also, according to the printing system of FIG. 1, it is possible to perform ideal ¼ Z-folding without specifying complex folding positions and easily provide high-value products in the form of good-looking bound documents by preventing errors. Also, according to the printing system of FIG. 1, it is possible to perform ¼ Z-folding in relation to finished size even if sheets have undergone binding, cutting, and folding. Furthermore, according to the printing system of the present embodiment, it is possible to avoid a situation in which a sheet which has undergone Z-folding is bound inadvertently even if folding positions are adjusted so as to avoid cutting.

Also, according to the printing system of FIG. 1, it is possible to obtain a bound document folded such that the second folding position will coincide with a position corresponding to half the sheet width excluding any cut width and binding margin by calculating the folding position using the calculation formulae described above.

Figure 10B:
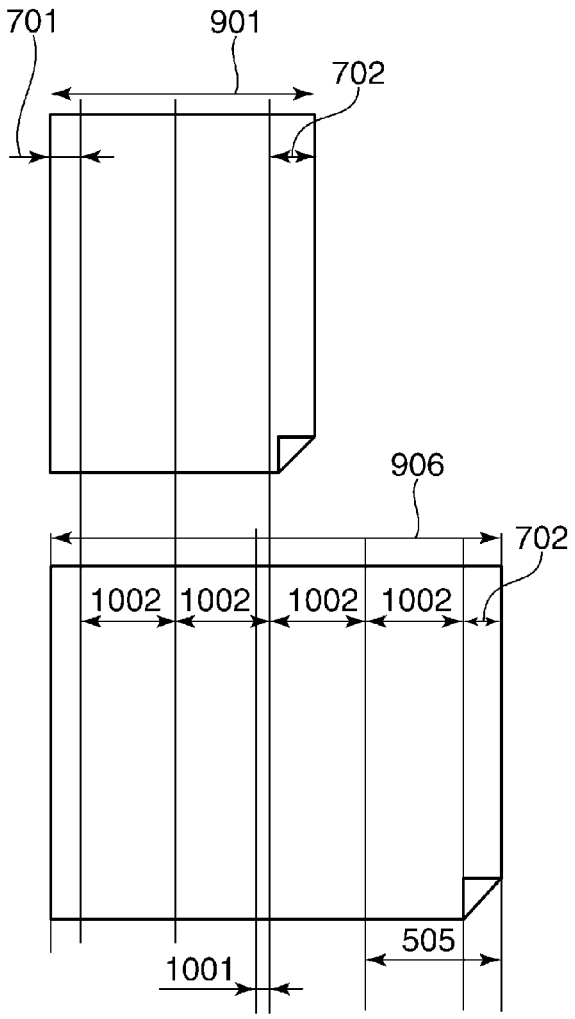
FIGS. 10A and 10B are views which are useful in explaining folding positions of sheets in the folding process performed by the post-processing apparatus of FIG. 4 with folding margins specified.

Next, another configuration example of the printing system of FIG. 1 will be described with reference to FIGS. 10A and 10B, wherein a folding margin is provided to avoid cutting a fold due to the problem of mechanical accuracy of the folding position and cutting position.

Figure 10A:
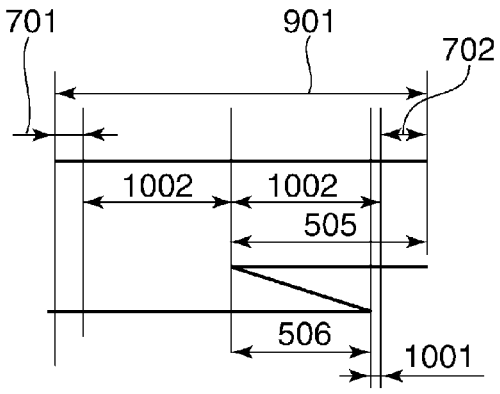

As shown in FIG. 10A, when a folding margin 1001 of approximately 5 mm is provided, a Z-folded width 1002 and the distance 505 from the end can be found using the calculation formulae described above.

The distance 1002 of binding is calculated as (220 mm−10 mm−10 mm)/2=100 mm while the distance 505 from the end is calculated as 100 mm+10 mm=110 mm By taking into consideration the folding margin 1001 of 5 mm, the control unit 204 exercises control so as to perform Z-folding by adjusting the positions of the second stopper 401 and the first stopper 407 in the paper folding machine 400 shown in FIG. 5. That is, by setting the distance between the second stopper 401 and the second nip 406 of the paper folding machine 400 to 100 mm−5 mm=95 mm, the control unit 204 can prevent a portion around a fold from being cut off due to the problem of mechanical accuracy.

In this case, the calculation formulae shown below are used.

Z-folded width 506=(sheet width 901−cut width 702−binding margin 701)/2−folding margin 1001 Calculation formula (3)

Distance 505 from the end=Z-folded width 506+cut width 702 Calculation formula (4)

That is, once the cut width 702, the binding margin 701, and the folding margin 1001 are determined, the printing system can automatically determine an ideal folding position from the sheet width 901 (paper size).

The processing functions shown in the processing of FIG. 11 can also be implemented by means of software (program) acquired via a network or any of various storage media and executed on a processing unit (CPU or processor) of a computer.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Applications No. 2010-279276, filed Dec. 15, 2010, which is hereby incorporated by reference herein in its entirety.

What is claimed is:

1. A sheet folding apparatus comprising:

a folding unit configured to perform a Z-folding process to provide first and second folds to a sheet;

a first obtaining unit configured to obtain a binding margin width of the sheet in a binding process performed to the sheet to which the Z-folding process has been performed;

a second obtaining unit configured to obtain a cut width of the sheet in a cutting process performed to the sheet to which the binding process has been performed;

a determination unit configured to determine respective first and second folding positions of the first and second folds in the sheet provided by the Z-folding process so that a first length between a cut edge-side free end of the sheet to which the cutting process has been performed and the first fold, which is closer to the cut edge-side free end of the sheet than the second fold, is half of a second length between a bound position and the second fold, which is closer to the bound position than the first fold, based on the binding margin width obtained by the first obtaining unit and the cut width obtained by the second obtaining unit; and a control unit configured to cause the Z-fold folding process to be performed based on the first and second folding positions determined by the determination unit.

2. The sheet folding apparatus according to claim 1, wherein the first obtaining unit obtains the binding margin width that is set by a user.

3. The sheet folding apparatus according to claim 1, wherein the second obtaining unit obtains the cut width that is set by a user.

4. The sheet folding apparatus according to claim 1, further including a binding unit performing the binding process, at a location downstream of the folding unit with respect a sheet conveyance direction of the sheet folding apparatus.

5. The sheet folding apparatus according to claim 4, further including a cutting unit performing the cutting process, at a location downstream of the binding unit in the sheet conveyance direction.

6. The sheet folding apparatus according to claim 1, wherein the binding process comprises a process of binding a sheet to which the Z-folding process is performed and a sheet to which the Z-folding process is not performed.

7. The sheet folding apparatus according to claim 1, further including a printing unit performing a printing process to the sheet, at a location upstream of the folding unit with respect to a sheet conveyance direction of the sheet folding apparatus.

8. The sheet folding apparatus according to claim 7, wherein the determination unit determines the respective folding positions before the printing unit starts the printing process.

9. A sheet folding method comprising:

a folding step of performing a Z-folding process to provide first and second folds to a sheet;

a first obtaining step of obtaining a binding margin width of the sheet in a binding process performed to the sheet to which the Z-folding process has been performed;

a second obtaining step of obtaining a cut width of the sheet in a cutting process performed to the sheet to which the binding process has been performed;

a determination step of determining respective first and second folding positions of the first and second folds in the sheet provided by the Z-folding process so that a first length between a cut edge-side free end of the sheet to which the cutting process has been performed and the first fold, which is closer to the cut edge-side free end of the sheet than the second fold, is half of a second length between a bound position and the second fold, which is closer to the bound position than the first fold, based on the binding margin width obtained at the first obtaining step and the cut width obtained at the second obtaining step; and a control step of causing the Z-fold folding process to be performed based on the first and second folding positions determined at the determination step.

10. A non-transitory computer readable storage medium storing a program executable by a computer to execute a sheet folding method comprising:

a folding step of performing a Z-folding process to provide first and second folds to a sheet;

a first obtaining step of obtaining a binding margin width of the sheet in a binding process performed to the sheet to which the Z-folding process has been performed;

a second obtaining step of obtaining a cut width of the sheet in a cutting process performed to the sheet to which the binding process has been performed;

a determination step of determining respective first and second folding positions of the first and second folds in the sheet provided by the Z-folding process so that a first length between a cut edge-side free end of the sheet to which the cutting process has been performed and the first fold, which is closer to the cut edge-side free end of the sheet than the second fold, is half of a second length between a bound position and the second fold, which is closer to the bound position than the first fold, based on the binding margin width obtained at the first obtaining step and the cut width obtained at the second obtaining step; and a control step of causing the Z-fold folding process to be performed based on the first and second folding positions determined at the determination step.

* * * * *